US011105058B2

(12) United States Patent
Holzapfel

(10) Patent No.: US 11,105,058 B2
(45) Date of Patent: Aug. 31, 2021

(54) DEVICE FOR CONTROLLING MOVEMENTS OF A FRONT- OR REAR-SIDE MOUNTED IMPLEMENT OF A SNOW GROOMER, AND SNOW GROOMER

(71) Applicant: Sven Holzapfel, Ulm (DE)

(72) Inventor: Sven Holzapfel, Ulm (DE)

(73) Assignee: KÄSSBOHRER GELÄNDEFAHRZEUG AG, Laupheim (DE)

( * ) Notice: Subject to any disclaimer, the term of this patent is extended or adjusted under 35 U.S.C. 154(b) by 331 days.

(21) Appl. No.: 16/001,229

(22) Filed: Jun. 6, 2018

(65) Prior Publication Data

US 2018/0355568 A1 Dec. 13, 2018

(30) Foreign Application Priority Data

Jun. 8, 2017 (DE) ..... 10 2017 209 707.8

(51) Int. Cl.
*E01H 4/02* (2006.01)

(52) U.S. Cl.
CPC ..... *E01H 4/02* (2013.01)

(58) Field of Classification Search
CPC .. E01H 4/02; E01H 4/00; E02F 3/7613; E02F 3/7618; E02F 3/844; E02F 3/7677; E02F 3/7631; E02F 3/7672
See application file for complete search history.

(56) References Cited

U.S. PATENT DOCUMENTS 3,653,451 A * 4/1972 Fryrear ..... E02F 3/7618 172/824
3,913,684 A * 10/1975 Casey ..... E02F 3/7613 172/821
4,013,132 A * 3/1977 Matsuzawa ..... E02F 3/7613 172/821
4,074,770 A * 2/1978 Frisbee ..... E02F 3/844 172/813

(Continued)

FOREIGN PATENT DOCUMENTS

DE 199 51 840 A1 10/2001
DE 101 14 092 A1 9/2002
JP 60-104463 U 7/1985

OTHER PUBLICATIONS

Office Action of European Patent Office issued in European Application No. 18173094 with English translation of category of cited documents, dated Nov. 13, 2018 (9 pages).

(Continued)

*Primary Examiner* — Jamie L McGowan
(74) *Attorney, Agent, or Firm* — Flynn Thiel, P.C.

(57) ABSTRACT

Device for controlling movements of a front- or rear-side mounted implement of a snow groomer including a kinematic system constructed from a plurality of actuating cylinders and transferable by a control unit into various functional positions which include pivoting movements of the mounted implement about a vertical axis, a transverse axis and a longitudinal axis, and also parallel shifting in the vertical direction. The kinematic system is additionally configured in such a manner that the mounted implement is shiftable in a translatory and/or parallel manner in a horizontal plane in the transverse direction and/or longitudinal direction relative to a vehicle frame of the snow groomer.

6 Claims, 9 Drawing Sheets

(56) References Cited

U.S. PATENT DOCUMENTS 4,083,414 A * 4/1978 Yokoyama ..... E02F 3/7613 172/821
4,111,268 A * 9/1978 Frisbee ..... E02F 3/7613 172/813
4,120,366 A * 10/1978 Nissen ..... E02F 3/7613 172/817
4,201,268 A * 5/1980 Frisbee ..... E02F 3/7613 172/812
RE31,642 E * 8/1984 Asal ..... E02F 3/7613 172/821
4,572,315 A * 2/1986 Caron ..... B62D 11/00 180/418
4,815,223 A * 3/1989 Brandt ..... B62D 7/14 172/173
5,010,961 A * 4/1991 Frisbee ..... E02F 3/7613 172/821
6,059,048 A * 5/2000 Subrt ..... E02F 3/7613 172/810
6,321,851 B1 11/2001 Weiss et al.
6,354,023 B1 3/2002 Trahan et al.
6,578,641 B2 6/2003 Bernhardt et al.
6,681,880 B2 * 1/2004 Bernhardt ..... G05G 9/047 172/442
6,827,155 B1 * 12/2004 Hoffart ..... A01B 59/044 172/821
7,008,168 B2 * 3/2006 Bernhardt ..... A01B 63/1006 172/272
10,323,382 B2 * 6/2019 Sharp ..... E02F 3/844
10,618,576 B2 * 4/2020 Kuhn ..... B62D 55/104
10,676,894 B2 * 6/2020 Sharp ..... E02F 3/815
2002/0125018 A1 * 9/2002 Bernhardt ..... A01B 59/068 172/439
2002/0134558 A1 * 9/2002 Bernhardt ..... A01B 69/004 172/7
2003/0217852 A1 * 11/2003 Bernhardt ..... A01B 59/068 172/200
2011/0035968 A1 * 2/2011 Wagger ..... E01H 4/02 37/223
2013/0185963 A1 7/2013 Wagger et al.
2016/0108603 A1 * 4/2016 Hoyt ..... E02F 3/7613 172/663
2016/0312421 A1 * 10/2016 Ummenhofer ..... E01H 4/02

OTHER PUBLICATIONS

Search Report of German Patent Office issued in Application No. 10 2017 209 707.8 dated Mar. 15, 2018 (7 pages).

* cited by examiner 4
6
2
7
8
3

4
2
7
8
6
3

DEVICE FOR CONTROLLING MOVEMENTS OF A FRONT- OR REAR-SIDE MOUNTED IMPLEMENT OF A SNOW GROOMER, AND SNOW GROOMER

CROSS-REFERENCE TO RELATED APPLICATIONS

This claims priority from German Application No. 10 2017 209 707.8, filed on Jun. 8, 2017, the disclosure of which is hereby incorporated by reference in its entirety.

FIELD, BACKGROUND AND SUMMARY OF INVENTION

The invention relates to a device for controlling movements of a front- or rear-side mounted implement of a snow groomer, comprising a kinematic system which is constructed from a plurality of actuating cylinders and is transferable by means of a control unit into various functional positions which comprise pivoting movements of the mounted implement about a vertical axis, a transverse axis and a longitudinal axis, and also parallel shifting in the vertical direction. The invention also relates to a snow groomer comprising such a device.

A device of this type for controlling movements of a front-side mounted implement of a snow groomer is generally known in the case of a snow groomer of the applicant's "PistenBully" type. The known snow groomer has, as a mounted implement on the front side, a clearing blade which is controllable by means of a kinematic system. The kinematic system has a plurality of hydraulic actuating cylinders which are adjustable via a control unit, which is activatable by a joystick in a driver's cab of the snow groomer, and thus produce movements of the clearing blade. The clearing blade can be pivoted by means of the kinematic system upwards and downwards about pivot axes extending in the transverse direction of the vehicle, can be pivoted to the left and to the right about a pivot axis extending in the vertical direction of the vehicle, can be tilted about a pivot axis extending in the longitudinal direction of the vehicle and can be shifted in parallel in the vertical direction by parallelogram pivoting movements of the kinematic system. In addition to the plurality of hydraulic actuating cylinders, the kinematic system comprises a main part which is coupled on the front side to a vehicle frame, extends horizontally in a starting position and is pivotable about a pivot axis in the transverse direction of the vehicle and on which two actuating cylinders act. On a side remote from the vehicle frame, a support which is oriented upright and to which the clearing blade is fastened is mounted pivotably on the main part.

It is the object of the invention to provide a device and a snow groomer of the type mentioned at the beginning which permit additional functionalities with little outlay.

This object is achieved in that the kinematic system is additionally configured in such a manner that the mounted implement is shiftable in a translatory and/or parallel manner in a horizontal plane in the transverse direction and/or longitudinal direction relative to a vehicle frame of the snow groomer. This gives rise to additional movement possibilities for the mounted implement, as a result of which the use possibilities of the mounted implement and accordingly the functionality of the snow groomer are improved. The kinematic system can be arranged on the front side or on the rear side on the snow groomer, depending on whether a front-side or a rear-side mounted implement is intended to be used. By means of the additional movability according to the invention, it is possible to shift the mounted implement forwards or rearwards in a translatory manner in a horizontal plane and thus to carry out push or pull movements. Alternatively or in addition, the mounted implement is shiftable either in a translatory or parallel manner in the transverse direction in the horizontal plane. The horizontal plane should be understood as meaning a vehicle plane which is defined by the transverse direction of the vehicle and the longitudinal direction of the vehicle and, when the snow groomer is positioned on a horizontal underlying surface, is oriented parallel to the underlying surface. A clearing blade is provided in particular as a front-side mounted implement. A rear tiller is provided in particular as a rear-side mounted implement. Alternatively, a track-setter can be provided as a rear-side mounted implement and a gripper, a front tiller or the like as a front-side mounted implement.

The object on which the invention is based is also achieved in that the kinematic system is configured as a self-supporting hexapod system. The term "self-supporting" should be understood as meaning that, in addition to the actuating cylinders, the kinematic system does not require any additional support elements extending between the vehicle frame and the mounted implement, and therefore freely supports the respective mounted implement. By this, it is meant that the movability of the mounted implement is advantageously dependent exclusively on the movability of the hexapod system. This in particular permits a change in the distance between the mounted implement and the vehicle frame in the longitudinal direction of the vehicle. Such an additional functionality does not arise in the prior art since the main part which extends between the vehicle frame and the mounted implement is merely coupled pivotably to the vehicle frame without permitting a translatory extension or retraction function. The self-supporting hexapod system consists exclusively of actuating cylinders which each, as seen on their own, have a linearly movable, extendable and retractable actuating piston. The actuating cylinders of the hexapod system extend substantially forwards or rearwards, depending in each case on the front- or rear-side mounting point on the snow groomer. As a result, the respective mounted implement is arranged at a distance from the snow groomer in the longitudinal direction thereof and is held in a self-supporting manner by the hexapod system.

In a refinement of the invention, the hexapod system has six actuating cylinders which are arranged in the manner of a hexapod with one end region on the vehicle frame and are coupled with an opposite end region to a support which is provided for the fastening of the mounted implement. The six actuating cylinders are coupled to the vehicle frame and, with their opposite end regions, support the support such that the latter is connected to the vehicle frame exclusively via the actuating cylinders.

In a further refinement of the invention, the support is designed for the releasable fastening of the mounted implement. For this purpose, the support is preferably provided with a receptacle on the side opposite the coupling of the actuating cylinders. In a further refinement of the invention, coupling points for the actuating cylinders on the support for the mounted implement are each configured as double coupling regions for two actuating cylinders in each case. Accordingly, in each case two actuating cylinders act in pairs on one double coupling region. This simplifies the connection of the actuating cylinders to the support.

In a further refinement of the invention, the kinematic system is assigned a measuring sensor system which senses movements or positions of the actuating cylinders and passes same on to the control unit, and the control unit has a memory for at least one predetermined control function of each actuating cylinder, which control function can be retrieved depending on signals sensed by the measuring sensor system. As a result, predetermined control functions can be initiated and executed in an automated manner for the shifting of the support and therefore of the mounted implement fastened thereto. The control unit preferably controls electronically corresponding hydraulic circuits of the preferably hydraulic actuating cylinders, wherein the control unit is assigned software which processes corresponding signals of the measuring sensor system and realizes the respectively desired control function. Different functional programs or automations of movement can be stored and realized here. Suitable points on the vehicle frame are provided as reference for the measurement signals of the measuring sensor system. Corresponding control functions of the actuating cylinders and therefore of the shifting of the respective mounted implement can either be produced by a driver of the snow groomer via an operating element in the form of a joystick or else stored as ready functional programs which merely have to be activated by a simple operating element, such as a switch or similar, in order then to carry out an automated movement sequence as far as a corresponding end position, such as, for example, a parking position.

In a further refinement, at least one manually actuatable operating element is provided which is provided for the retrieval of the at least one control function by a driver of the snow groomer. Such an operating element can be an operating switch, an operating button, an operating lever or the like. The operating element is preferably arranged within reach of a driver's sitting position within a driver's cab of the snow groomer.

For the snow groomer of the type mentioned at the beginning, the object on which the invention is based is achieved in that said snow groomer has at least one device provided on the front side and/or rear side, as has been described with reference to the previous paragraphs.

BRIEF DESCRIPTION OF THE DRAWINGS

Further advantages and features of the invention emerge from the claims and from the description below of a preferred exemplary embodiment of the invention that is illustrated with reference to the drawings.

DETAILED DESCRIPTION

Figure 1:
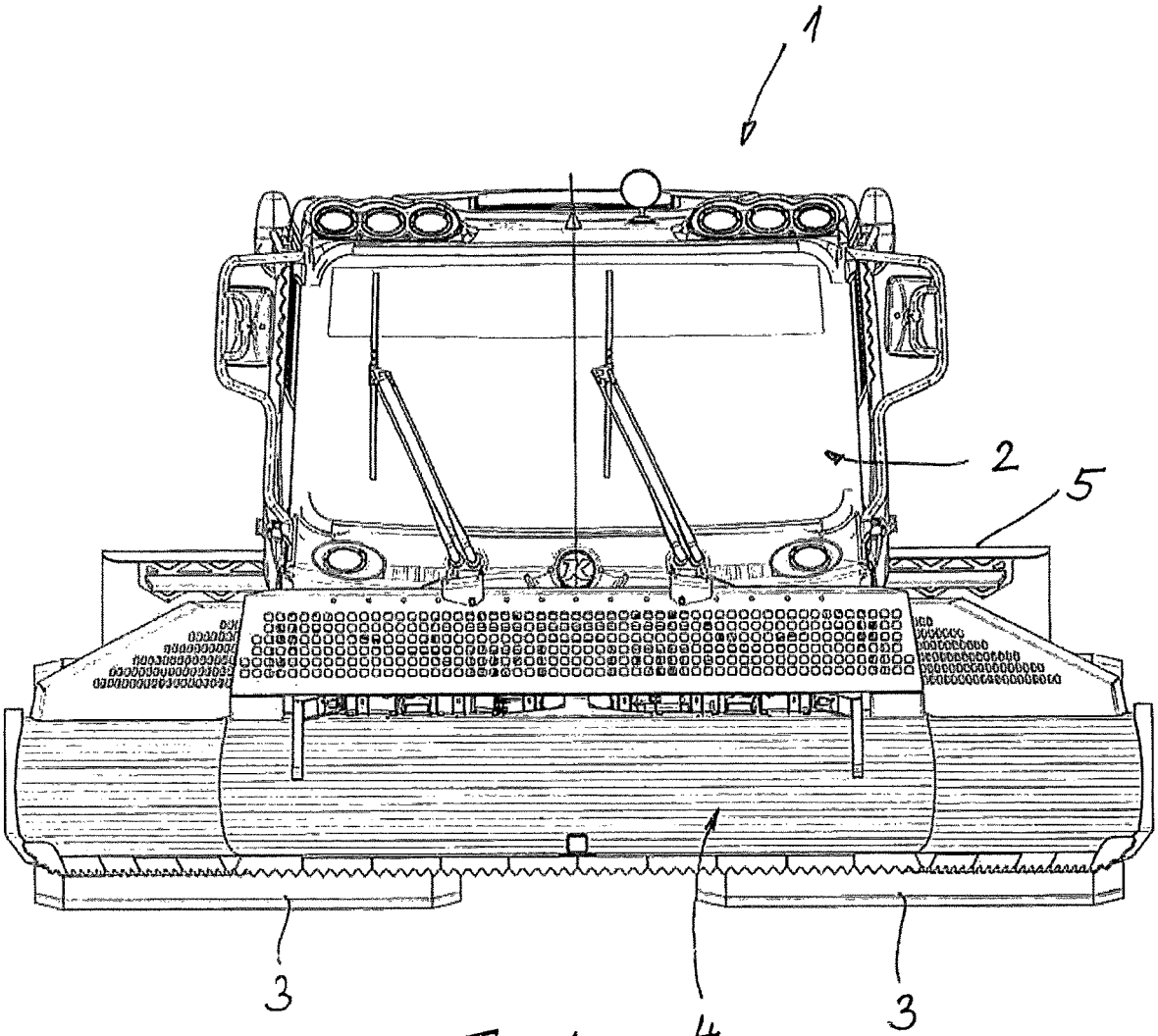
FIG. 1 shows an embodiment of a snow groomer according to the invention in a front view.
Figure 2:
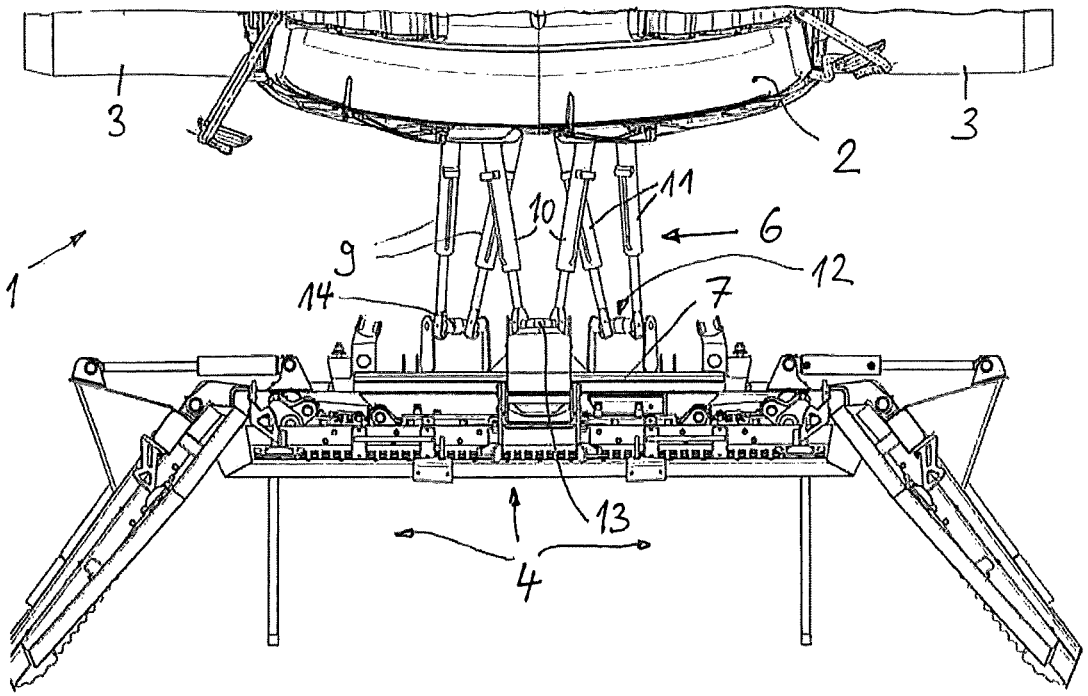
FIG. 2 shows, in a top view, a partial region of the snow groomer according to FIG. 1 in the region of a front-side mounted implement and with an embodiment of a device according to the invention for controlling the front-side mounted implement.

A snow groomer 1 according to FIGS. 1 to 17 has a driver's cab 2 which is positioned on the front side on a vehicle frame 8. The snow groomer 1 is provided with a crawler undercarriage which comprises two crawler tracks 3 on opposite sides of the vehicle frame 8. The snow groomer 1 is provided for the creation and preparation of snow pistes. For this purpose, the snow groomer 1 has both a front-side mounted implement in the form of a clearing blade 4 and a rear-side mounted implement in the form of a rear tiller 5.

The clearing blade 4 is arranged on the front side on the vehicle frame 8 of the snow groomer 1 by means of a device for controlling movements of the clearing blade 4. The device has a kinematic system which is designed as a hexapod system 6 and is described in more detail below.

The hexapod system 6 has a total of six hydraulic actuating cylinders 9 to 11 which are mounted on the rear side on a front of the vehicle frame 8 in the region of corresponding coupling points 15 to 17 so as to be pivotable about pivot axes extending at least substantially in the transverse direction of the vehicle. Each actuating cylinder 9 to 11 in each case has a piston rod which is coupled to an opposite end region of the actuating cylinder 9 to 11 in the region of a support 7 which is oriented substantially upright. For the coupling of the actuating cylinders 9 to 11, a total of three double coupling regions 12 to 14 are provided, of which a central double coupling region 13 is provided in the region of an upper side of the support 7 and two lateral double coupling regions 12, 14 are provided in the region of a lower side of the support 7. The total of six actuating cylinders 9 to 11 are each positioned in pairs with respect to one another in accordance with a hexapod, wherein two upper actuating cylinders 10 are guided from an upper coupling region 17 on the vehicle frame 8 to the central double coupling region 13. The two actuating cylinders 9, which are arranged on the left in the top view according to FIG. 2 and of which one actuating cylinder 9 is coupled to the upper coupling region 16 and the other actuating cylinder 9 is coupled to the lower coupling region 15, are coupled by their opposite end regions, i.e. the piston rods, to the lower double coupling region 14 which is on the left in the top view according to FIG. 2. In a corresponding mirror-symmetrical manner with respect to a vertical center longitudinal axis of the vehicle, the opposite two actuating cylinders 11 are coupled on the right side to the vehicle frame 8 likewise in the region of an upper coupling region 16, on the one hand, and of a lower coupling region 15, on the other hand, and extend forwards towards the support 7. The two actuating cylinders 11 are coupled to the support 7 in the region of the right lower double coupling region 12 (as seen in the top view according to FIG. 2). All of the actuating cylinders 9 to 11 are designed as double-action actuating cylinders, and therefore they can be retracted and extended in a hydraulically controlled manner.

Figure 3:
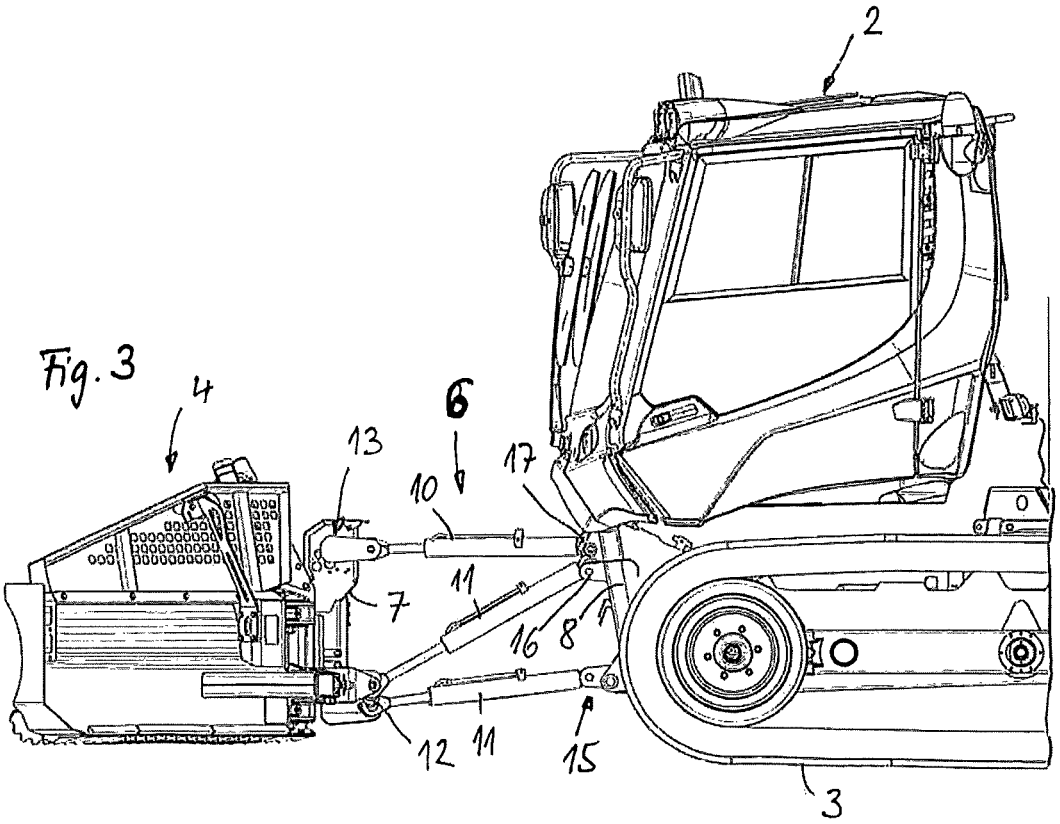
FIG. 3 shows a side view of the snow groomer in the region of the front-side mounted implement with the device according to FIG. 2, FIGS. 4 and 5 show the snow groomer according to FIGS. 1 to 3 with translatory shiftings of the mounted implement which have taken place in the longitudinal direction.
Figure 4:
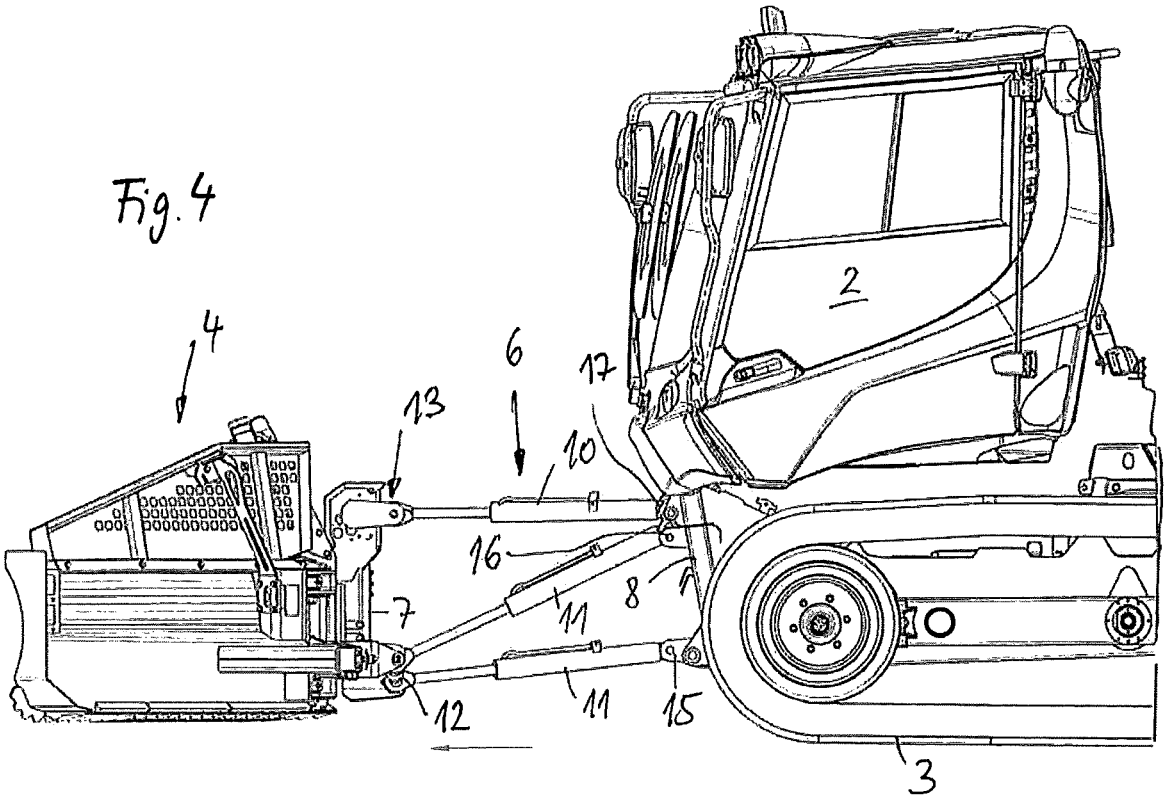
Figure 5:
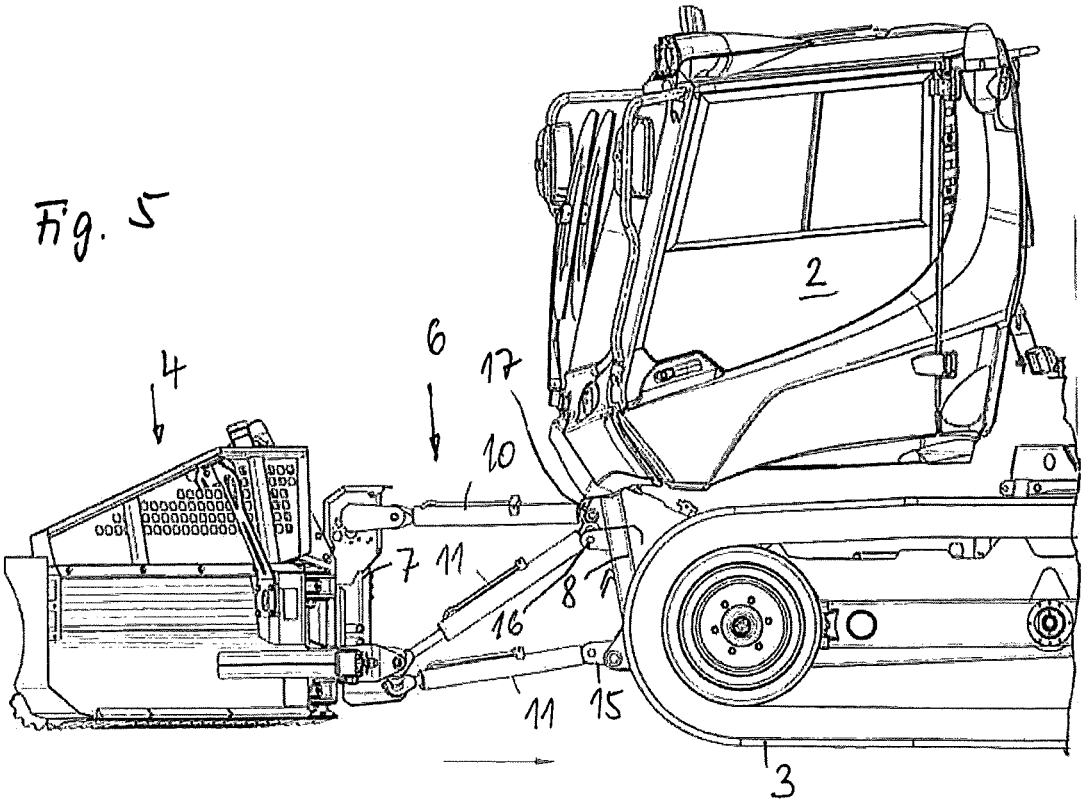

The support 7 is freely supported by means of the total of six actuating cylinders 9 to 11 of the hexapod system 6, as can readily be seen with reference to FIG. 3. The support 7 is provided on a front side opposite the double coupling regions 12 to 14 with a receptacle (not denoted specifically) for supporting the clearing blade 4. The clearing blade 4 is fastened, preferably releasably, to the support 7.

In order to control the hexapod system 6, a control unit (not illustrated specifically) is provided which is realized electronically and acts on an electrohydraulic controller of the actuating cylinders 9 to 11 by means of electronic control commands. Each actuating cylinder 9 to 11 is in each case assigned a measuring sensor, the measuring sensors together forming a measuring sensor system within the meaning of the invention. The measuring sensors can sense movements and positions of the actuating cylinders 9 to 11 in relation to the vehicle frame 8, wherein corresponding receptacles on the vehicle frame 8 at the coupling regions 15 to 17 serve as reference points for sensing the corresponding measurement signals. The measuring sensor system is connected to the electronic control unit which has an electronic memory for at least one control function program which comprises automated movement sequences and positionings for the support 7, and therefore for the clearing blade 4, and is realized by software. The sensed measurement signals of the measuring sensor system are compared with desired values of the predetermined control programs and evaluated so that the control unit can control the actuating cylinders 9 to 11 in accordance with the desired control functions. The corresponding control functions are activated in the region of a driver's sitting position within the driver's cab 2 by a corresponding manually operable actuating element.

By means of the described control device, a multiplicity of control movements for the clearing blade 4, which are explained with reference to FIGS. 4 to 17, can be carried out by means of the hexapod system (likewise described). It is thus possible, according to FIGS. 4 and 5, to shift the support 7, and therefore the clearing blade 4, forwards or rearwards in a translatory manner in the longitudinal direction of the vehicle, which is clarified by the two arrows in FIGS. 4 and 5.

Figure 6:
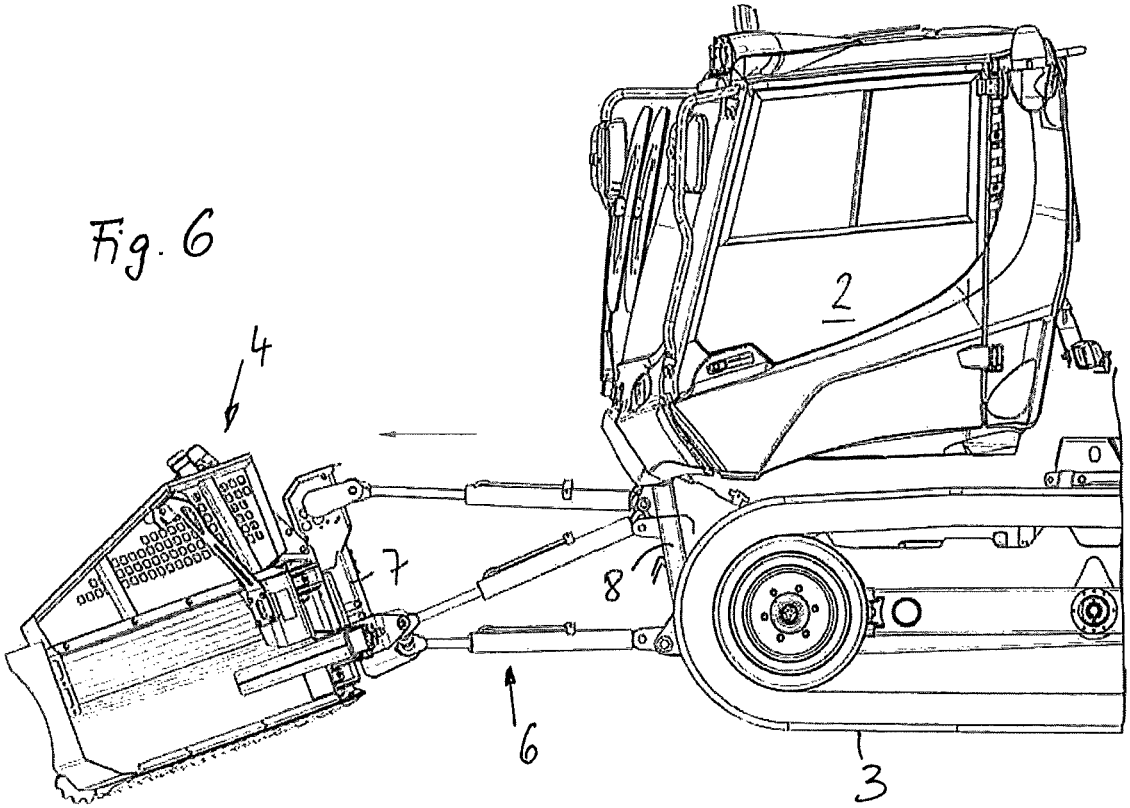
FIGS. 6 and 7 show the snow groomer according to FIGS. 1 to 5 with a mounted implement which is raised or lowered by the device.
Figure 7:
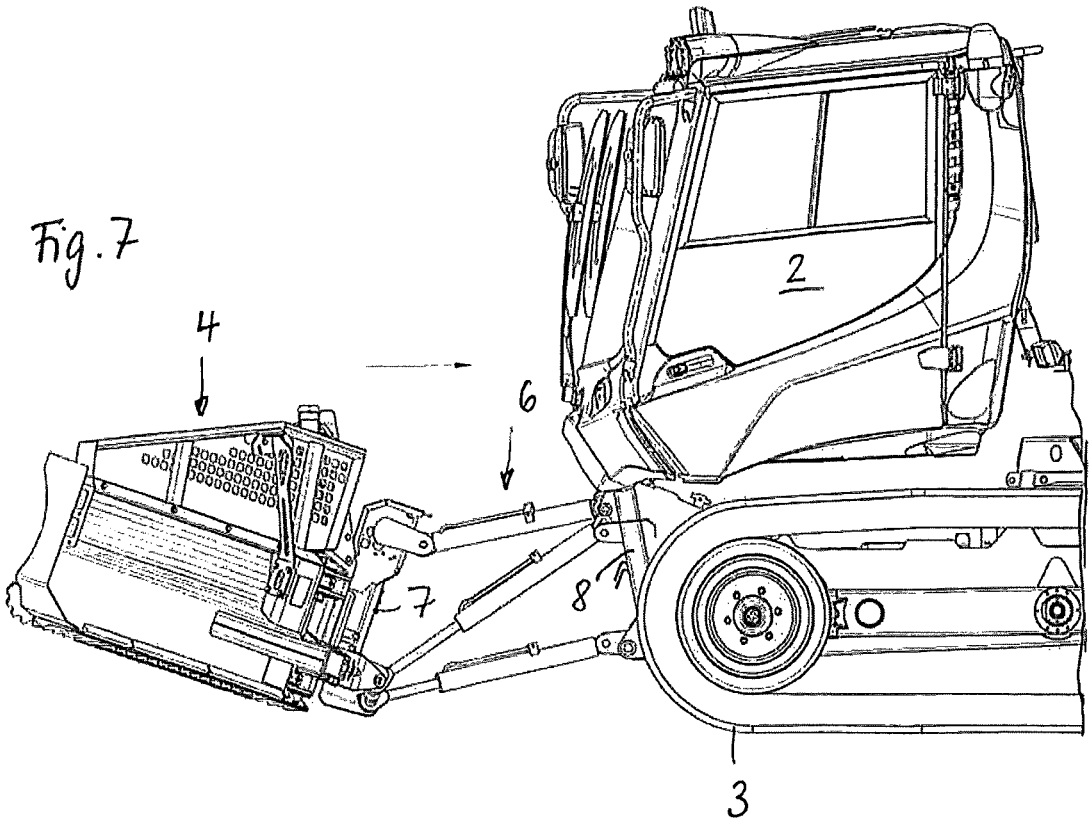

In addition, it is possible, according to FIGS. 6 and 7, to tilt the support 7 and therefore the clearing blade 4 forwards and downwards or to position same obliquely upwards. The corresponding movements which are carried out by the hexapod system 6 are again illustrated by the two arrows in FIGS. 6 and 7.

Figure 8:
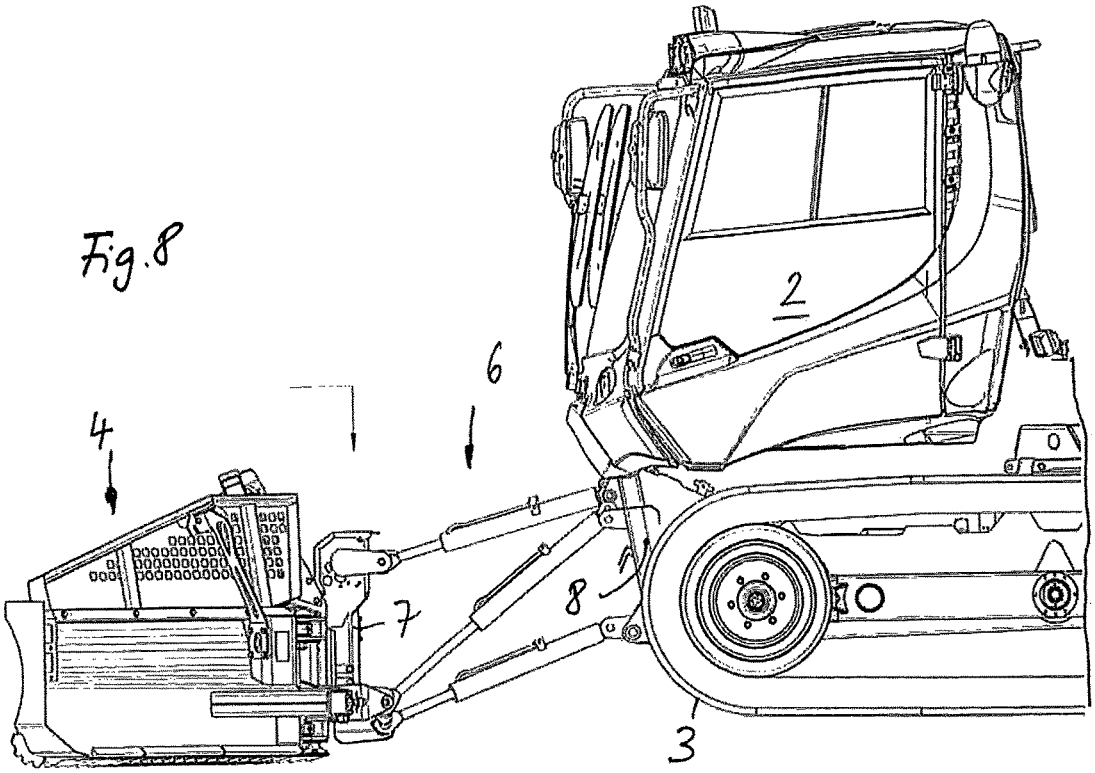
FIGS. 8 and 9 show the snow groomer according to FIGS. 1 to 7 with the mounted implement shifted downwards or upwards in parallel.
Figure 9:
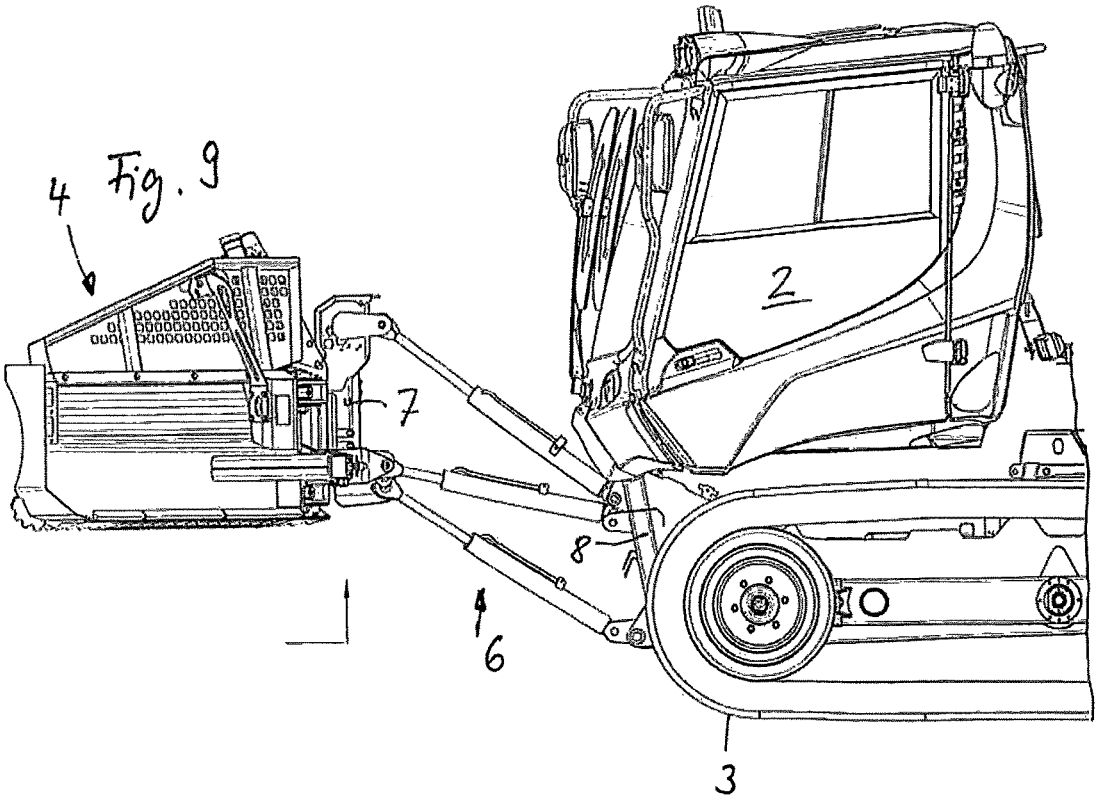

In addition, it is possible to shift the support 7 and therefore the clearing blade 4 upwards or downwards in a translatory or parallel manner in the vertical direction, as is illustrated with reference to FIGS. 8 and 9. The corresponding movement directions are also shown here by the two arrows.

Figure 10:
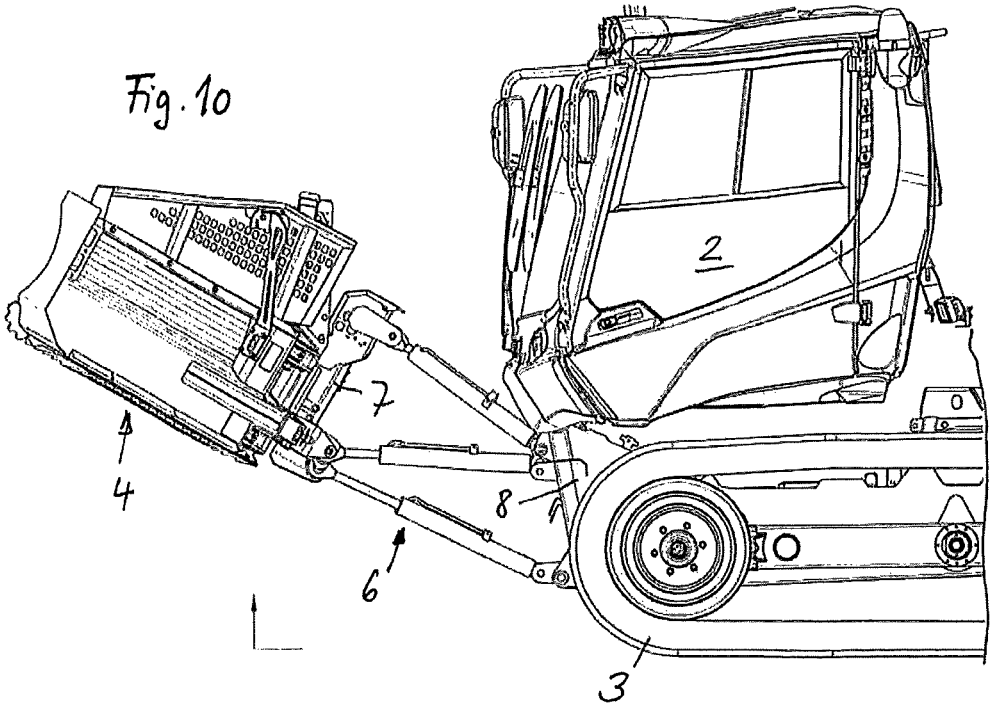
FIGS. 10 and 11 show the snow groomer according to FIGS. 1 to 9 with the mounted implement pivoted upwards or downwards.
Figure 11:
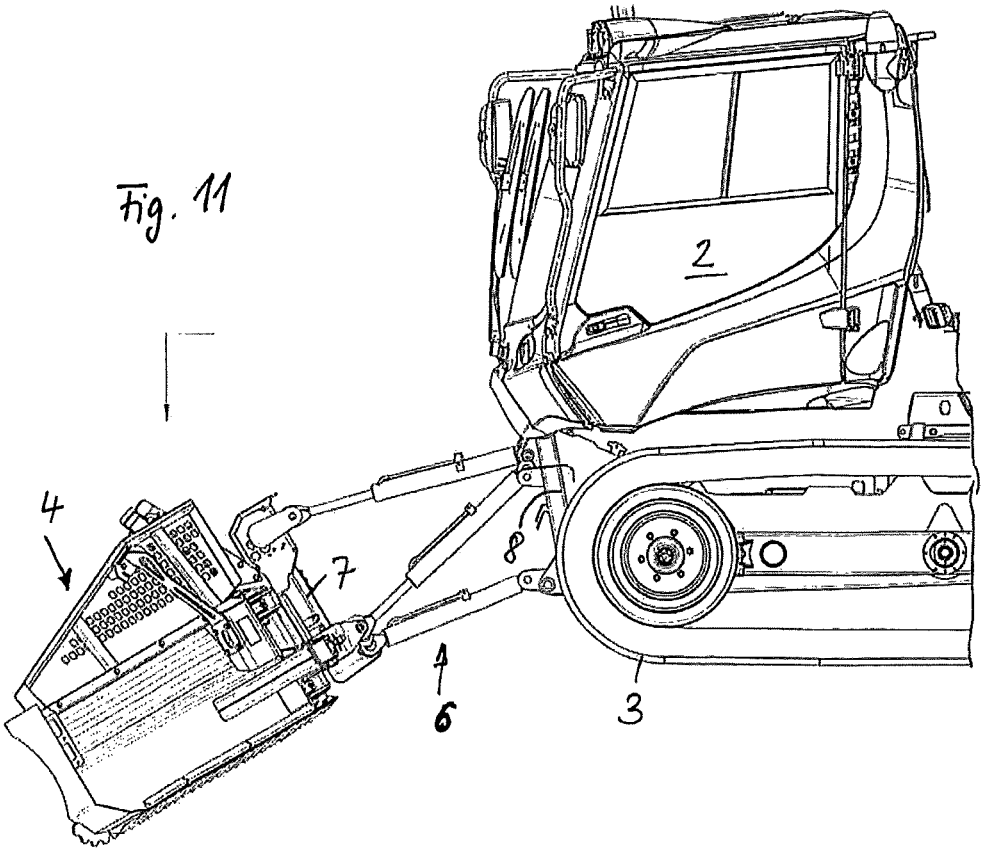

A further movement function is explained with reference to FIGS. 10 and 11. The support 7 including the hexapod system 6 and the clearing blade 4 can be pivoted upwards or downwards about an imaginary pivot axis extending in the transverse direction of the vehicle in the region of the vehicle frame 8. The pivoting downwards takes place here as far as below a plane defined by a lower side of the crawler undercarriage 3.

Figure 12:
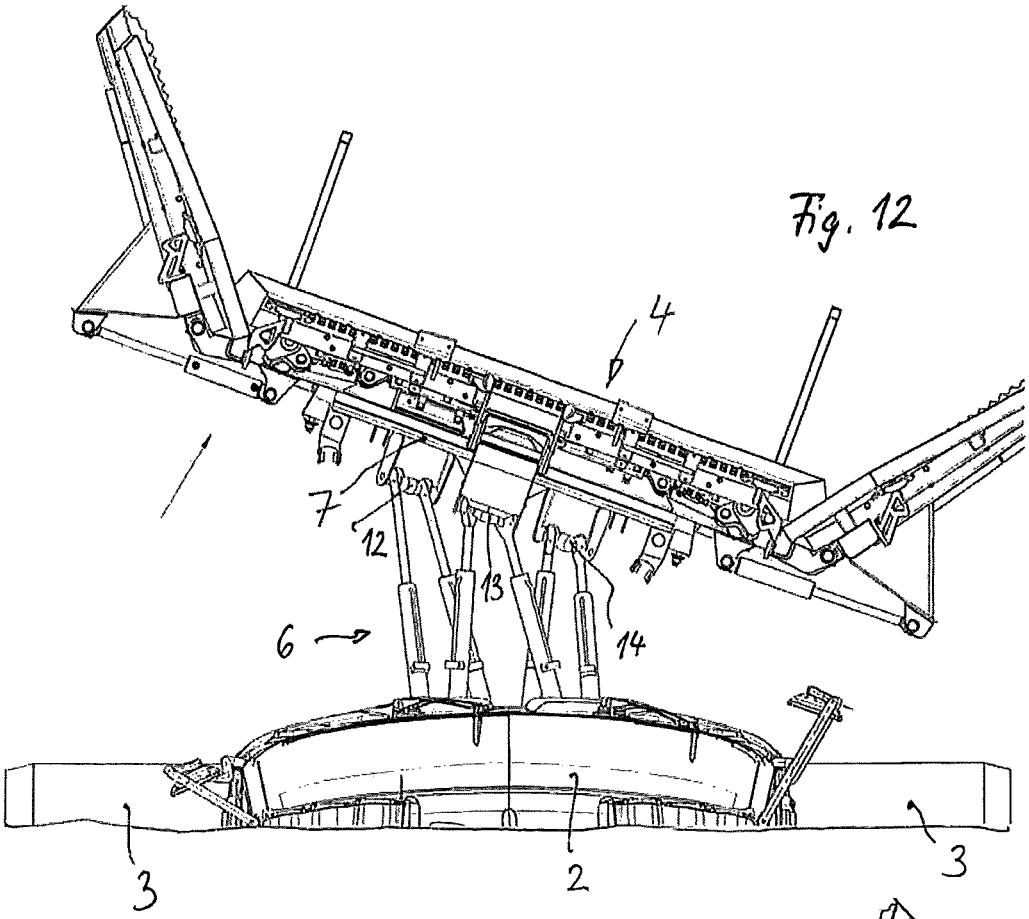
FIGS. 12 and 13 show, in a top view, the snow groomer according to FIGS. 1 to 11 with the mounted implement pivoted to the right or to the left.
Figure 13:
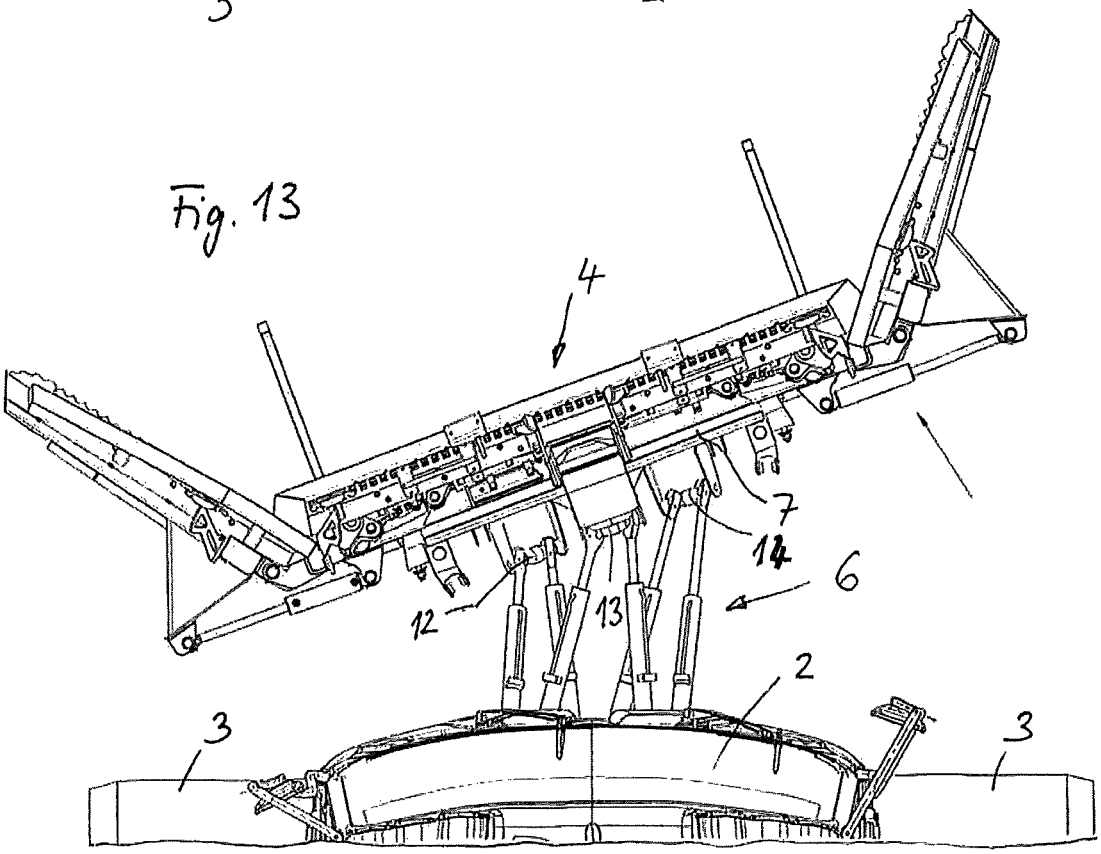

According to FIGS. 12 and 13 (likewise see the two arrow depictions there), the support 7 can be rotated to the right (FIG. 12) or to the left (FIG. 13) about a pivot axis extending in the vertical direction of the vehicle by means of the hexapod system 6.

Figure 14:
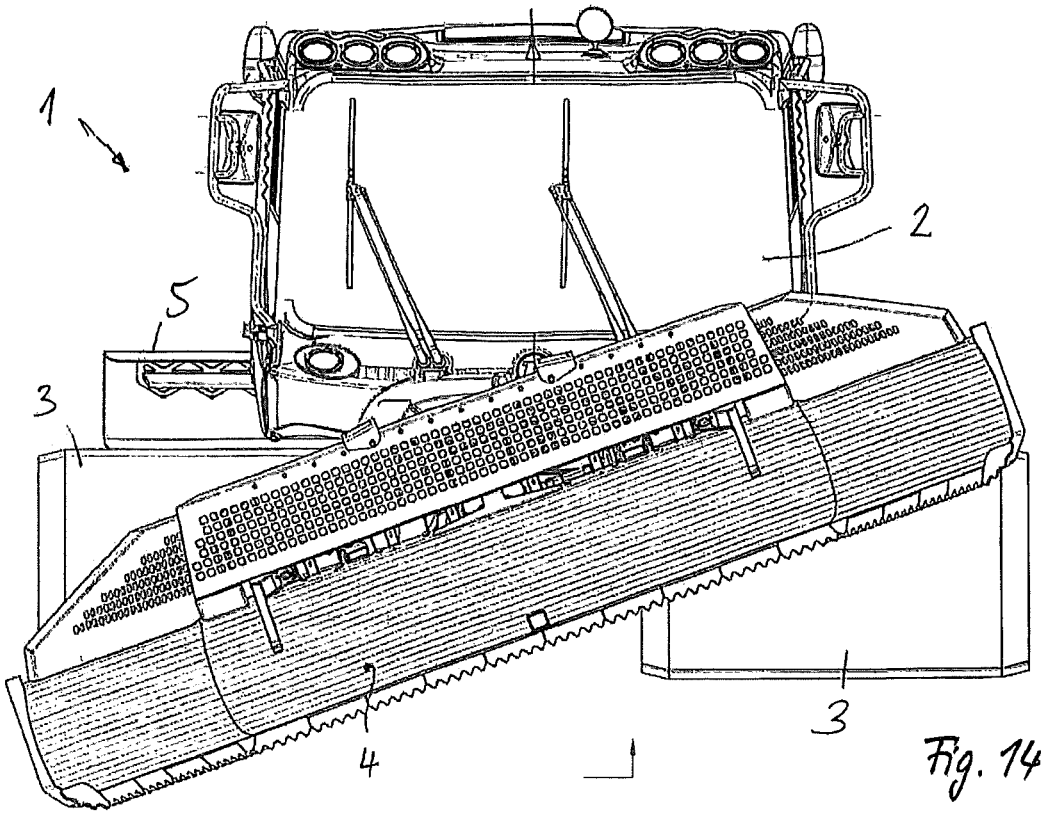
FIGS. 14 and 15 show the snow groomer according to FIGS. 1 to 13 with a mounted implement rotated to the left or to the right about a pivot axis extending in the longitudinal direction of the vehicle.
Figure 15:
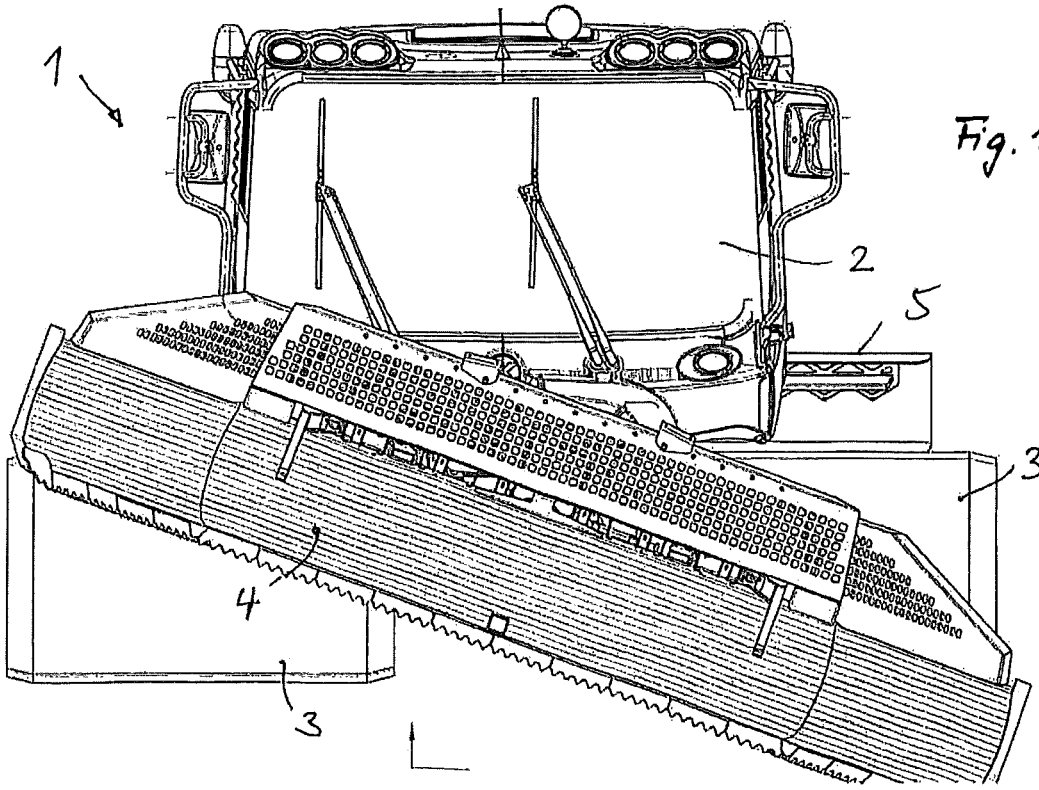

According to FIGS. 14 and 15, the hexapod system 6 is also provided to rotate the clearing blade 4, and therefore also the support of the control device, to the left (FIG. 14) or to the right (FIG. 15) about an axis of rotation extending in the longitudinal direction of the vehicle. Such a rotation is also referred to as tilting since it defines a limited rotation about a longitudinal axis of the vehicle.

Figure 16:
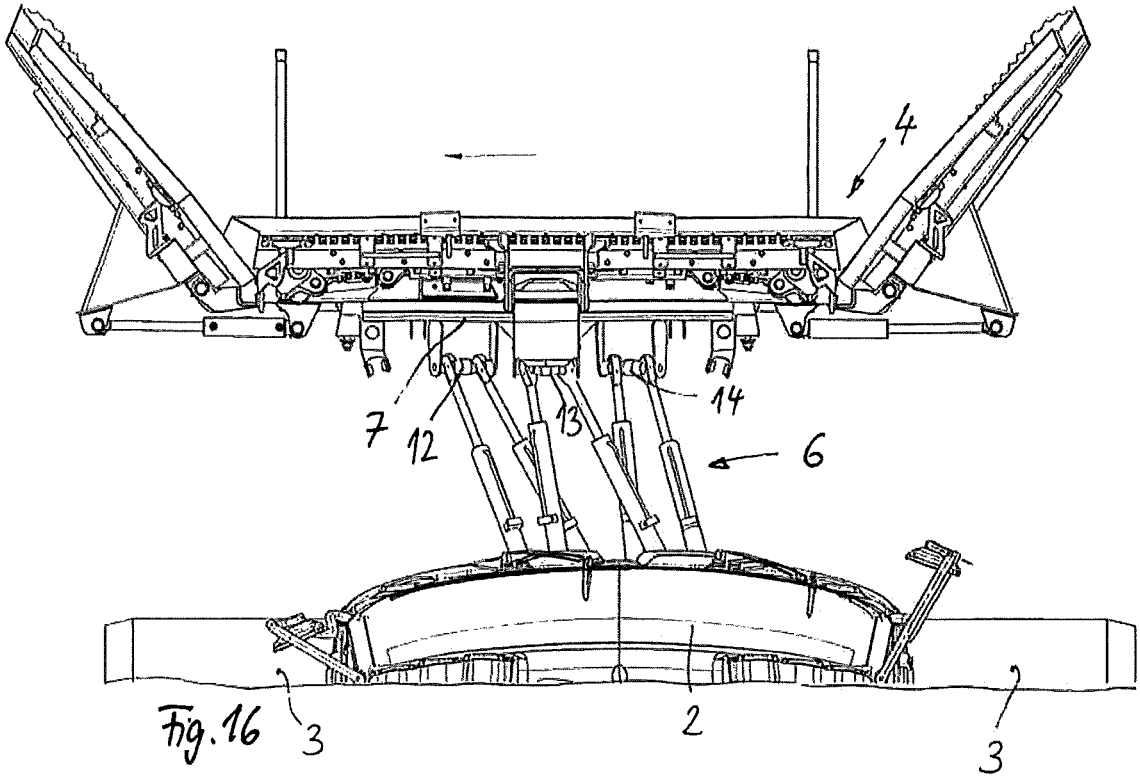
FIGS. 16 and 17 show the snow groomer according to FIGS. 1 to 15 with the mounted implement shifted in a translatory manner to the left or to the right.
Figure 17:
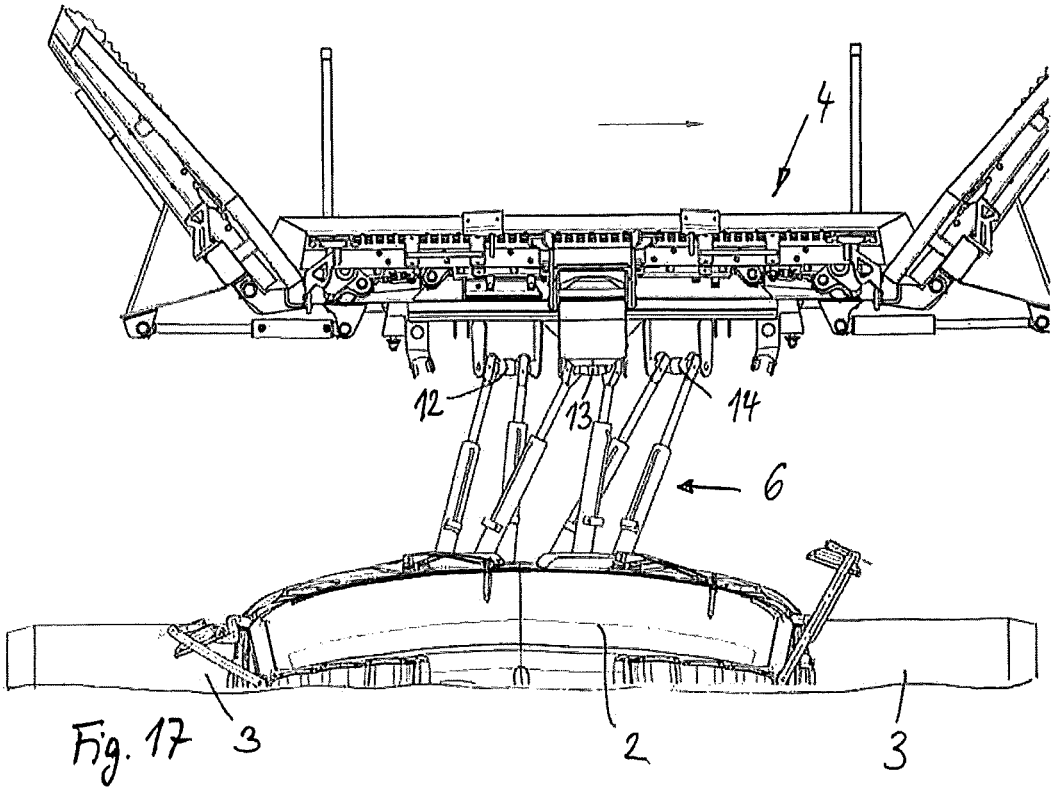

According to the illustrations according to FIGS. 16 and 17, the clearing blade 4 including the support 7 can also be shifted in a translatory manner to the left (FIG. 16) or in a translatory manner to the right in a horizontal plane defined by a transverse direction of the vehicle and a longitudinal direction of the vehicle.

The large number of movement possibilities permits additional functionalities for the snow groomer 1 that are advantageous in particular for the creation of fun parks in ski areas.

The invention claimed is:

1. A snow piste groomer comprising a frame having a front side, at least one crawler track mounted on the frame, a snow clearing blade mounted on the front side of the frame, and a device for controlling movements of the snow clearing blade, the device comprising a kinematic system transferable by a control unit into various functional positions which comprise pivoting movements of the snow clearing blade about a vertical axis, a transverse axis and a longitudinal axis, and also parallel shifting in the vertical direction, wherein the kinematic system is additionally configured such that the snow clearing blade is shiftable in a translatory and/or parallel manner in a horizontal plane in a transverse direction and/or in a longitudinal direction relative to the frame, the kinematic system including a snow clearing blade support disposed adjacent the front side of the frame, the snow clearing blade being fastened to the snow clearing blade support, the kinematic system being configured as a self-supporting hexapod system having six actuating cylinders arranged in the manner of a hexapod, the actuating cylinders having respective first end regions coupled to the front side of the frame and second end regions spaced from the respective first end regions and coupled to the snow clearing blade support.

2. The snow piste groomer according to claim 1, wherein the snow clearing blade support is configured to permit releasable fastening of the snow clearing blade thereto.

3. The snow piste groomer according to claim 1, wherein the snow clearing blade support includes coupling points, each coupling point being configured as a double coupling region to which the second end regions of two of the actuating cylinders are coupled.

4. The snow piste groomer according to claim 1, further including a measuring sensor system which senses movements or positions of the actuating cylinders and passes same on to the control unit, and the control unit has a memory for at least one predetermined control function of each actuating cylinder, each at least one predetermined control function being retrievable depending on signals sensed by the measuring sensor system.

5. The snow piste groomer according to claim 4, further including at least one manually actuatable operating element for the retrieval of the at least one predetermined control function by a driver of the snow piste groomer.

6. A snow piste groomer comprising:

a frame having first and second sides spaced from one another in a transverse direction transverse to a front-to-rear longitudinal direction of the snow piste groomer, a front side and a rear side spaced from the front side in the longitudinal direction;

a pair of crawler tracks mounted on a lower side of the frame adjacent the respective first and second sides thereof;

a snow clearing implement disposed at the front side of the frame; and a device for controlling movement of the snow clearing implement, the device comprising a kinematic system transferable via a control unit into various functional positions including:

pivoting movements of the snow clearing implement about a vertical axis, a transverse axis oriented transversely to the longitudinal direction and a longitudinal axis oriented parallel to the longitudinal direction; translatory shifting movements of the snow clearing implement in a vertical direction; and translatory shifting movements of the snow clearing implement relative to the frame in a horizontal plane in the transverse direction and/or in the longitudinal direction, the kinematic system comprising a snow clearing implement support disposed adjacent the front side of the frame and fastened to the snow clearing implement and six actuating cylinders arranged in the manner of a hexapod, each of the actuating cylinders extending between the frame and the snow clearing implement support and having a first end region coupled to the front side of the frame and a second end region spaced from the respective first end region and coupled to the snow clearing implement support, the snow clearing implement support and the snow clearing implement fastened thereto being supported on the snow piste groomer solely by the actuating cylinders extending between the frame and the snow clearing implement support.

* * * * *